US006079179A

United States Patent [19]

Shoemaker, Jr.

[11] Patent Number: 6,079,179

[45] Date of Patent: Jun. 27, 2000

[54] CONSTRUCTION ANCHOR BOLT AND RETAINER FOR POURED CONCRETE

[76] Inventor: Charles S. Shoemaker, Jr., 8417 Arlington St., Raytown, Mo. 64138

[21] Appl. No.: 09/168,553

[22] Filed: Oct. 8, 1998

[51] Int. Cl.[7] ..... E04B 1/36

[52] U.S. Cl. ..... 52/699; 52/704; 52/296; 411/82; 411/396

[58] Field of Search ..... 52/295, 699, 704, 52/705, 707, 708, 711, 296, 698; 44/82, 258, 396, 409

[56] References Cited

U.S. PATENT DOCUMENTS

| | | | |
|---|---|---|---|
| D. 312,382 | 11/1990 | Ryll . | |
| 1,089,874 | 3/1914 | Smith | 52/711 |
| 2,403,541 | 7/1946 | Molat | 52/711 |
| 2,428,676 | 10/1947 | Moore | 52/704 |
| 2,952,947 | 9/1960 | White | 52/711 |
| 3,401,733 | 9/1968 | Circle | 52/711 |
| 3,960,356 | 6/1976 | Adams . | |
| 4,283,899 | 8/1981 | Wakamiya | 52/699 |
| 4,309,135 | 1/1982 | Gutshall . | |
| 4,408,940 | 10/1983 | Fischer . | |
| 4,641,478 | 2/1987 | Nelson, Jr. . | |
| 4,932,818 | 6/1990 | Garwood . | |
| 5,050,364 | 9/1991 | Johnson . | |
| 5,379,563 | 1/1995 | Tinsley | 52/295 |
| 5,388,804 | 2/1995 | Cohen . | |
| 5,404,689 | 4/1995 | DiNarda . | |
| 5,505,033 | 4/1996 | Matsuo et al. . | |
| 5,653,563 | 8/1997 | Ernst . | |

*Primary Examiner*—Richard Chilcot
*Attorney, Agent, or Firm*—Shughart Thomson & Kilroy P.C.

[57] ABSTRACT

A combination construction anchor bolt and retainer for poured concrete installations includes an anchor bolt retaining sleeve which contains an anchor bolt and which is adapted for attachment to a concrete form such that it is imbedded in poured concrete after removal of the form. The sleeve has a single point along its length where its inside diameter matches the bolt outside diameter but the sleeve inside diameter tapers outward from that dimension both above and below that point. This dual tapered design allows the anchor bolt to be adjusted slightly after concrete has been poured and set around the sleeve. The sleeve includes a bolt head retaining pocket and a plurality of wings which prevent it from turning after concrete has set around it.

24 Claims, 2 Drawing Sheets

CONSTRUCTION ANCHOR BOLT AND RETAINER FOR POURED CONCRETE

FIELD OF THE INVENTION

The present invention relates to a construction anchor bolt and retainer for poured concrete installations, and, more particularly to an anchor bolt retaining sleeve which contains an anchor bolt and which is adapted for attachment to a concrete form such that it is imbedded in poured concrete after removal of the form. The sleeve has a single point along its length where its inside diameter matches the bolt outside diameter but the sleeve inside diameter tapers outward from that dimension both above and below that point. The dual tapers allow the bolt to be moved slightly after the concrete is poured to allow adjustment for installation of bolted seats or other fixtures with slightly varying hole placements.

BACKGROUND OF THE INVENTION

Anchor bolts have traditionally been installed in poured concrete floors by rigidly attaching the bolts to concrete forms, typically made of wood, and pouring the concrete floor such that the poured concrete sets around the bolt to embed the anchor bolt and hold it permanently in place. The imbedded anchor bolts can then be used to anchor fixtures, such as stadium seats, which are typically provided with predrilled bolt holes. A problem occurs when the bolts are positioned slightly askew or slightly offset in position, or when the predrilled bolt holes in the fixture vary somewhat in position from a predetermined bolt pattern. In these situations, if the anchor bolts are firmly imbedded in the concrete, an installer has little choice but to enlarge the bolt holes or over stress the bolts in an effort to conform them to the hole pattern, which often results in weakening the anchoring plate, breaking or otherwise damaging the anchor bolt, the concrete floor, etc.

A number of prior attempts have been made to construct anchor bolt retainers which allow some flexibility of the bolt position after pouring of the concrete. One example is found in U.S. Pat. No. 4,408,940 to Mark Fischer, entitled ANCHOR BOLT ASSEMBLY. This patent is directed to an anchor bolt anchor sleeve for poured concrete floors which includes a plate with a central bore through which an anchor bolt is preinserted and, optionally, tightened down to the plate via an internal nut. Concrete is poured around the sleeve, leaving a void in the hollow sleeve. The combination of the sleeve and the plate is said to allow some flexibility in bolt movement after the concrete is poured, apparently since the bolt can be more easily bent due to the void.

Another attempt to create a flexible bolt anchoring system is taught in U.S. Pat. No. 5,404,689 to Dennis DiNarda, and entitled ANCHOR BOLT SLEEVE. This patent is directed to an anchor bolt sleeve which surrounds an anchor bolt shank to prevent concrete from directly surrounding the shank. The sleeve is shown as being corrugated, allowing it to expand lengthwise to accommodate different bolt sizes. As in the Fischer patent, concrete is poured around the sleeve, imbedding the sleeve but leaving a void around the bolt. Again, the stated purpose is to allow the bolts to be bent in the void so that their position can be adjusted slightly to match varying bolt hole positions in fixtures to be installed.

In both the Fischer and DiNarda patents, the anchor bolts must still be bent to adjust the bolt position above the concrete. Bending an anchor bolt can be difficult and also inevitably weakens the bolt itself. Applying enough pressure to the bolt to bend it usually requires some type of leveraged tool, which can damage the threads of the bolt. Finally, concrete can be inadvertently poured directly into the open top of the Fischer sleeve, thus filling the intended void. The expandable sleeve body of the DiNarda patent cannot be readily attached to concrete forms and appears to be subject to failure due to the flexible sidewalls.

It is clear, then, that a need exists for a more convenient and effective construction bolt anchor and retainer which allows the bolt to be adjusted slightly in position after a concrete floor has been poured around it. Such an anchor bolt and retainer should allow adjustment of the bolt without bending or otherwise weakening or damaging the bolt itself.

SUMMARY OF THE INVENTION

The present invention is directed to a construction bolt anchor and retainer for poured concrete, and, more particularly, to such a retainer which comprises a substantially cylindrical sleeve which is designed for attachment beneath a plywood form such that it is imbedded in a poured concrete floor upon removal of the form. The sleeve includes a number of wings which protrude outward radially from a base portion of the sleeve to prevent the sleeve from turning after the concrete is poured and set. A threaded bolt is preinserted into the sleeve prior to use and a pocket is formed in the base portion of the sleeve which both retains the bolt head and prevents it from spinning. The pocket is somewhat larger than the bolt head, which allows the anchor bolt some freedom of movement laterally within the pocket. A detent is formed in the bottom of the sleeve pocket beneath the bolt head to retain the bolt in position within the sleeve. The sleeve has an upper portion which contains the anchor bolt shaft. The sleeve upper portion has an inner diameter just above the bolt head pocket which is larger than the outer diameter of the bolt shaft at the bottom of the sleeve. The sleeve upper portion inner diameter then tapers inward along the length of the sleeve upper portion until it reaches its narrowest point at a position approximately ¾ inches from the top of the sleeve. At this point, the sleeve upper portion inner diameter is just slightly greater than the bolt shaft outer diameter. The sleeve upper portion inner diameter then tapers outward from that narrow point toward the top of the sleeve as it again becomes considerably greater than the bolt shaft outer diameter. The taper at the top of the sleeve upper portion is preferably more pronounced than at the bottom and and the sleeve upper portion inner diameter widens to a greater degree at the top than the bottom. The combination of the double tapered sleeve upper portion inner diameter and the bolt head pocket being slightly larger than the retained bolt head, allow the bolt to be adjusted in angle after the sleeve is imbedded in hardened concrete. This allows the anchor bolts to be shifted slightly, without bending, to compensate for variations in bolt hole patterns in fixtures to be installed as well as to compensate for slightly misplaced anchor bolt and sleeve locations in the concrete floor itself. Should greater adjustment be required, the greater diameter of the top of the sleeve upper portion inner diameter does allow the bolt shaft to be bent without destroying the sleeve or cracking the concrete.

OBJECTS AND ADVANTAGES OF THE INVENTION

The principal objects of the present invention include: providing an improved anchor bolt and retainer for poured concrete floors; providing such an anchor bolt and retainer which combines retainer and bolt for easy installation; providing such an anchor bolt and retainer which includes a sleeve with an upper portion which has a double tapered inner diameter; providing such an anchor bolt and retainer in which the sleeve has a base portion with a pocket positioned to retain the bolt head and to prevent the bolt head from being rotated relative to the sleeve, but which also allows some lateral movement of the bolt head relative to the pocket; providing such an anchor bolt and retainer in which the sleeve includes a plurality of wings protruding outward radially therefrom to prevent the sleeve from turning after concrete had been poured and set around it; providing such an anchor bolt and retainer in which the bolt can be shifted, without bending, to allow adjustment to compensate for variations in bolt hole patterns in fixtures as well as to compensate for slightly misplaced anchor bolt and sleeve locations in the concrete floor itself; and to provide such an anchor bolt and retainer which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
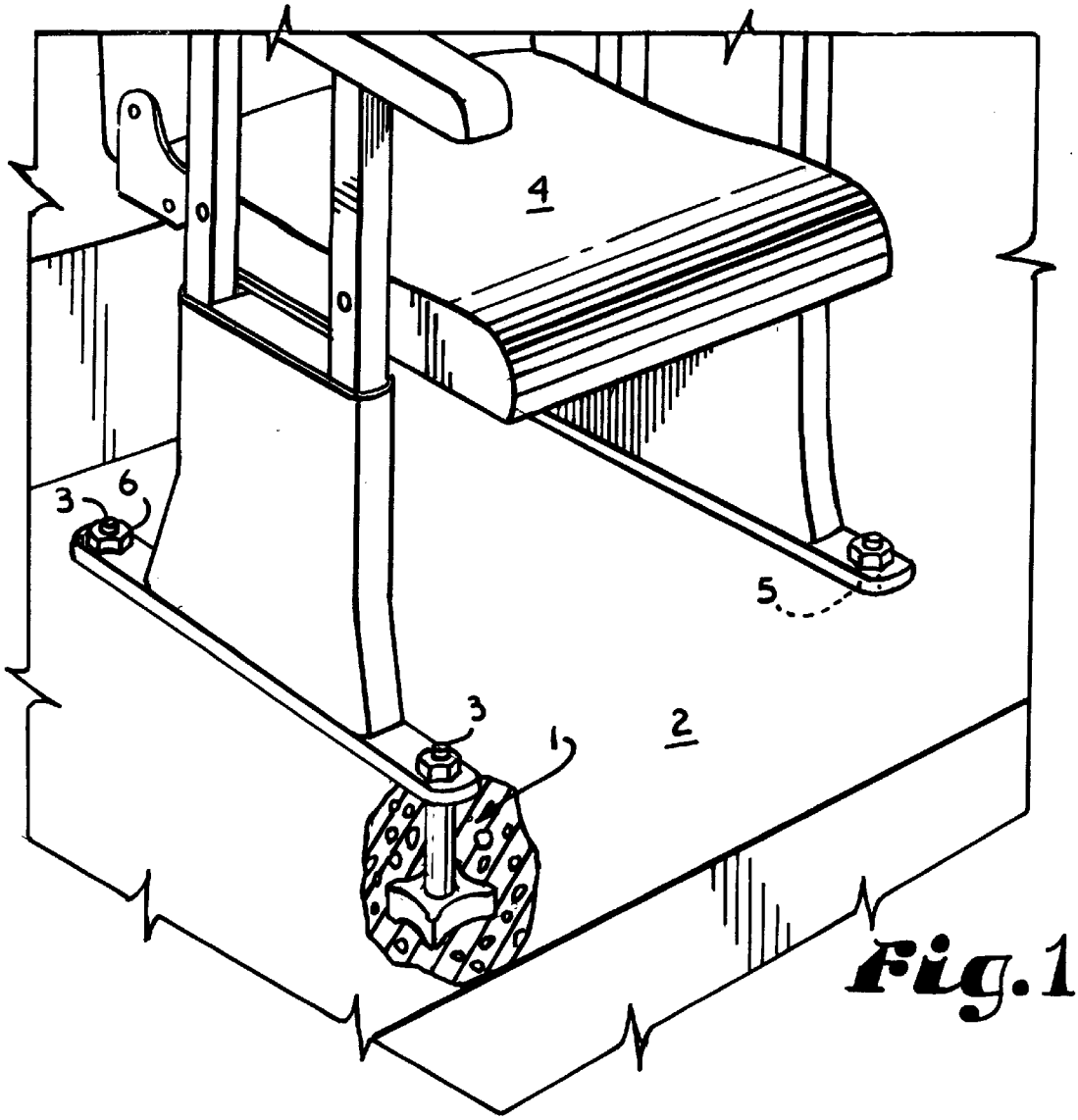
FIG. 1 is a perspective view of a stadium seat installed on a concrete floor, with a portion of the floor shown broken away to illustrate one of the inventive anchor bolt and retainers imbedded in the concrete floor.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–4, the inventive anchor bolt and retainer is illustrated and indicated generally at 1. The anchor bolt and retainer 1 is designed for use in a poured concrete floor, such as the stadium seat floor 2 in FIG. 1. When the anchor bolts and retainers 1 are installed, a portion of a threaded bolt shaft 3 protrudes upward from the concrete floor 2 to provide an anchoring system for fixtures such as the stadium seat 4. The stadium seat 4 includes a number of predrilled anchor holes 5 extending through a base plate 11 and the anchor bolt and retainers 1 are positioned in the floor 2 to coincide with the anchor holes 5. A like plurality of anchor nuts 6 are used to secure the seat 4 to the anchor bolt shafts 3.

A problem occurs when the anchor holes 5 are slightly offset from standard, but the anchor bolt and retainers 1 are already installed in the concrete floor 2 in a standard configuration. In this situation, the position of the bolt shafts 3 must be adjusted slightly to coincide with the bolt holes 5, which the present invention is designed to facilitate.

Figure 4:
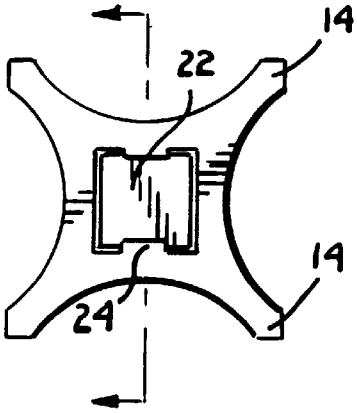
FIG. 4 is a top plan view of the anchor bolt and retainer, illustrating the wings protruding radially outward around the base of the sleeve.
Figure 2:
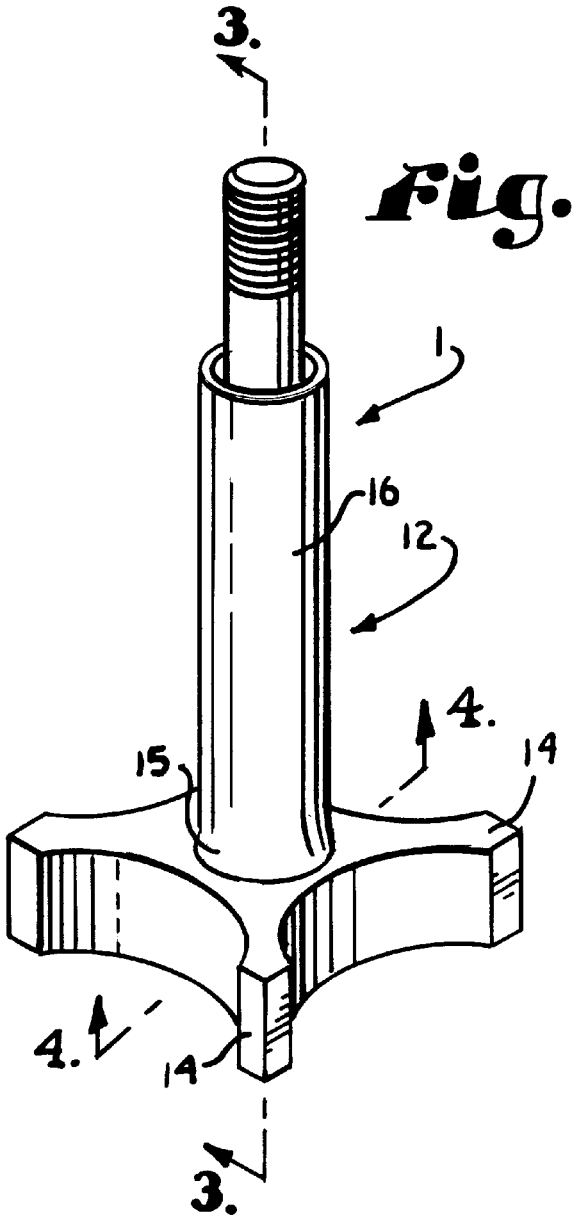
FIG. 2 is a perspective view of an anchor bolt and retainer in accordance with the present invention.
Figure 3:
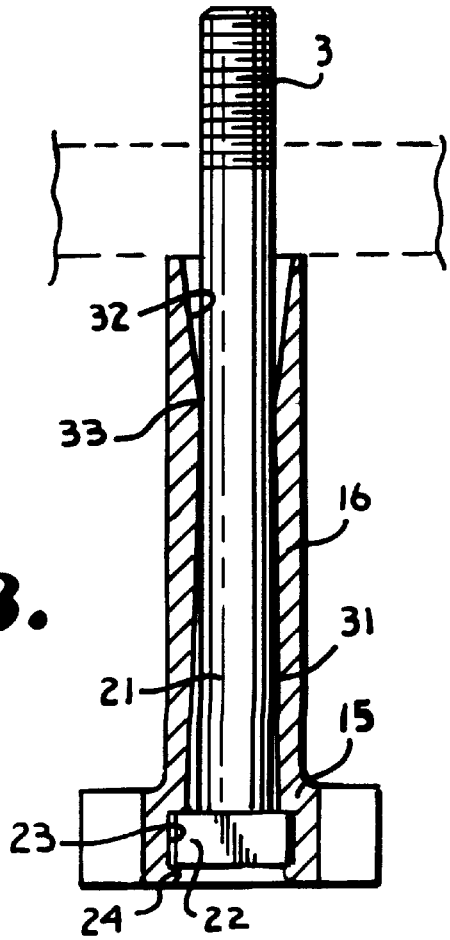
FIG. 3 is a cross-sectional view of the anchor bolt and retainer, taken along line 3—3 of FIG. 2, and illustrating the double tapering of the sleeve upper portion inner diameter.

Referring to FIGS. 2–4, the anchor bolt and retainer 1 includes a substantially cylindrical sleeve 12 which is designed for attachment beneath a plywood form (not shown). The sleeve 12 includes a number of wings 14, here shown as four in number, which wings 14 protrude outward radially from a base portion 15 of the sleeve 12 to prevent the sleeve 12 from turning due to torque applied to the bolt shaft 3 after the concrete floor 2 has been poured and has set around it. The sleeve also includes an elongate upper portion 16, as explained below.

A threaded bolt 21 is preinserted into the sleeve 12 prior to use with a bolt head 22 occupying a pocket 23 formed in the base portion 15 of the sleeve 12 and the bolt shaft 3 occupies the upper portion 16. The pocket 23 is shaped as a square to match the square shape of the bolt head 22 in order to both retain the bolt head 22 and prevent it from spinning. The pocket 23 is somewhat larger than the bolt head 22, which allows the bolt head 22 some freedom of movement laterally within the pocket 23. The pocket 23 forms a pair of detents 24 at the bottom of the pocket 23, which detents 24 retain the bolt head 22 and prevent the bolt 21 from dropping out of the sleeve 12.

The sleeve upper portion 16 forms an inner region 31 with an inner diameter 32 which inner diameter 32 is somewhat larger than the outer diameter of the bolt shaft 3 just above the pocket 23. The sleeve inner region 32 then tapers inward as one proceeds upward along the length of the sleeve 12 until the inner diameter 32 reaches its narrowest point at a position 33 approximately ¾ inch from the top of the sleeve 12. At this position 33, the sleeve inner diameter 32 is just slightly greater than the bolt shaft 3 outer diameter. The sleeve inner diameter 32 then tapers outward from the position 33 toward the top of the sleeve 12 as it again becomes considerably greater than the bolt shaft 3 outer diameter. The taper at the top of the sleeve upper portion 16 is preferably more pronounced than at the bottom and the sleeve upper portion inner diameter 32 widens to a greater degree at the top. The combination of the double tapered sleeve inner diameter 31 and the over sizing of the bolt head pocket 23 allow the anchor bolt 21 to be adjusted in angle after the sleeve 12 is imbedded in hardened concrete. Again, this allows the anchor bolts 21 to be shifted slightly, without bending, to compensate for variations in bolt hole patterns in fixtures, such as the stadium seat 4, to be installed as well as to compensate for slightly misplaced anchor bolt and sleeve locations in the concrete floor itself. Should greater adjustment be required, the greater diameter of the top of the sleeve upper portion does allow the bolt shaft to be bent without destroying the sleeve or cracking the concrete.

In a preferred embodiment of the invention, the overall height of the sleeve 12 was 3.09 inches, with the height of the wings 14 being 0.47 inches. The inner diameter 31 of the sleeve 12 tapered inward from 0.5 inches at the widest to 0.375 inches at the narrowest, with the narrow point being located at position 33 0.75 inches from the top of the sleeve 12. The anchor bolt 21 was a ⅜-16×4" square head bolt and the bolt head pocket 23 was 0.344 inches deep.

Variations of detail will occur to those of ordinary skill in the art. For example, while the sleeve 12 has been illustrated as being substantially cylindrical, it can be any other desired shape, including triangular, square, hexagonal, etc., as long as the interior dimension tapers outward in both directions from a minimum dimension which is slightly larger than the bolt shaft outer diameter. The claims thus refer to the "inner dimension" rather than the "inner diameter" of the retainer. The placement of the wings 14 at the base of the sleeve 12 and the number of the wings 14 are exemplary only, and any number of wings 14 and any position of the wings 14 along the length of the sleeve 12 will suffice to prevent turning of the sleeve 12. The position of the narrow point position 33 along the length of the sleeve 12 can be changed as long as it allows the anchor bolt 21 to be freely adjusted. It is conceivable that the bolt 21 and sleeve 12 could be fabricated as a single item, with the sleeve 12 being attached directly to the bolt 21, and still accomplish the objectives of the invention. It is thus to be understood that while certain forms of the present invention have been illustrated and described herein, it is not to be limited to the specific forms or arrangement of parts described and shown.

I claim:

1. A combination anchor bolt and retainer, comprising:

a. an anchor bolt with a bolt head and a bolt shaft;

b. a hollow elongate bolt retaining member which comprises:

i. an upper portion with an inner dimension sized to accommodate an outer diameter of said bolt shaft, said bolt shaft being somewhat longer than the length of said upper portion such that it extends upward beyond said upper portion when said bolt is received within said retaining member; and ii. a base portion including a pocket sized and shaped to receive and retain said bolt head and to prevent said bolt head from being turned within said pocket, said base portion having a detent extending into said pocket below and across a portion of said bolt head to prevent said bolt head from dropping downwardly out of said pocket.

2. A combination anchor bolt and retainer as in claim 1, wherein said elongate bolt retaining member upper portion inner dimension tapers inward from the bottom up to a point of narrowest dimension and then tapers outward from that point to a top of the upper portion, said point of narrowest dimension being slightly larger than the outer diameter of said bolt shaft.

3. A combination anchor bolt and retainer as in claim 2, wherein the top of said elongate bolt retaining member upper portion widens outward to a greater degree than at the bottom of the retaining member upper portion.

4. A combination anchor bolt and retainer as in claim 1, wherein said pocket is larger than said bolt head.

5. A combination anchor bolt and retainer as in claim 1, and further comprising at least one wing extending outward from either said upper portion or said base portion of said elongate bolt retaining member.

6. A combination anchor bolt and retainer as in claim 5, wherein there are a plurality of said wings attached to and extending radially outward from said base portion of said elongate bolt retaining member.

7. A combination anchor bolt and retainer, comprising:

a. an anchor bolt with a bolt head and a bolt shaft;

b. a hollow elongate bolt retaining member which comprises:

i. an upper portion with an inner dimension which tapers inward from the bottom up to a point of narrowest dimension and then tapers outward from that point to a top of the upper portion, said point of narrowest dimension being slightly larger than the outer diameter of said bolt shaft, said bolt shaft being somewhat longer than the length of said upper portion such that it extends upward beyond said upper portion when said bolt is received within said retaining member; and ii. a base portion including a pocket sized and shaped to receive and retain said bolt head and to prevent said bolt head from being turned within said pocket.

8. A combination anchor bolt and retainer as in claim 7, wherein the top of said elongate bolt retaining member upper portion widens outward to a greater degree than at the bottom of said retaining member upper portion.

9. A combination anchor bolt and retainer as in claim 7, wherein said base portion includes a detent extending into said pocket below and across a portion of said bolt head to prevent said bolt head from dropping downwardly out of said pocket.

10. A combination anchor bolt and retainer as in claim 7, and further comprising at least one wing extending outward from either said upper portion or said base portion of said elongate bolt retaining member.

11. A combination anchor bolt and retainer as in claim 10, wherein there are a plurality of said wings attached to and extending radially outward from said base portion of said elongate bolt retaining member.

12. A combination anchor bolt and retainer as in claim 7, wherein said pocket is larger than said bolt head.

13. A combination anchor bolt and retainer, comprising:

a. an anchor bolt with a bolt head and a bolt shaft;

b. a hollow elongate bolt retaining member which comprises:

i. an upper portion with an inner dimension sized to accommodate an outer diameter of said bolt shaft, said bolt shaft being somewhat longer than the length of said upper portion such that it extends upward beyond said upper portion when said bolt is received within said retaining member;

ii. a base portion including a pocket sized and shaped to receive and retain said bolt head and to prevent said bolt head from being turned within said pocket; and iii. at least one wing extending outward from either said upper portion or said base portion.

14. A combination anchor bolt and retainer as in claim 13, wherein there are a plurality of said wings attached to and extending radially outward from said base portion of said elongate bolt retaining member.

15. A combination anchor bolt and retainer as in claim 13, wherein said base portion includes a detent extending into said pocket below and across a portion of said bolt head to prevent said bolt head from dropping downwardly out of said pocket.

16. A combination anchor bolt and retainer as in claim 13, wherein said elongate bolt retaining member upper portion inner dimension tapers inward from the bottom up to a point of narrowest dimension and then tapers outward from that point to a top of the upper portion, said point of narrowest dimension being slightly larger than the outer diameter of said bolt shaft.

17. A combination anchor bolt and retainer as in claim 16, wherein the top of said elongate bolt retaining member upper portion widens outward to a greater degree than at the bottom of said retaining member upper portion.

18. A combination anchor bolt and retainer as in claim 13, wherein said pocket is larger than said bolt head.

19. A combination anchor bolt and retainer, comprising:

a. an anchor bolt with a bolt head and a bolt shaft; and b. a hollow elongate bolt retaining member which comprises:

i. a tubular portion with an inner dimension sized to accommodate an outer diameter of said bolt shaft, said bolt shaft being somewhat longer than the length of said tubular portion such that it extends beyond said tubular portion when said bolt is received within said retaining member; and ii. a head retaining portion including a pocket, said pocket being sized and shaped to receive and retain said bolt head and to prevent said bolt head from being turned within said pocket, said pocket having a first opening in communication with said tubular portion and a second opening opposite said first opening, said head retaining portion also including a detent extending into said pocket between said bolt head and said second opening and across a portion of said bolt head to prevent said bolt head from slipping out of said pocket through said second opening.

20. A combination anchor bolt and retainer as in claim 19, wherein said elongate bolt retaining member tubular portion has a proximate end adjacent to said head retaining portion, a distal end furthest from said head retaining portion, and said tubular portion inner dimension tapers inward from the proximate end to a point of narrowest dimension and then tapers outward from that point to the distal end, said point of narrowest dimension being slightly larger than the outer diameter of said bolt shaft.

21. A combination anchor bolt and retainer as in claim 20, wherein said tubular portion inner dimension widens outward to a greater degree at the distal end of said tubular portion than at the proximate end.

22. A combination anchor bolt and retainer as in claim 19, wherein said pocket is larger than said bolt head.

23. A combination anchor bolt and retainer as in claim 19, and further comprising at least one wing extending outward from either said tubular portion or said head retaining portion of said elongate bolt retaining member.

24. A combination anchor bolt and retainer as in claim 23, wherein there are a plurality of said wings attached to and extending radially outward from said head retaining portion of said elongate bolt retaining member.

* * * * *